United States Patent [19]

Offermann et al.

[11] 4,296,938

[45] Oct. 27, 1981

[54] IMMERSION-TYPE SEAL FOR THE STANDPIPE OPENING OF COKE OVENS

[75] Inventors: Ludwig Offermann, Olfen; Rheinhold Wippich, Recklinghausen, both of Fed. Rep. of Germany

[73] Assignee: Firma Carl Still GmbH & KG, Recklinghausen, Fed. Rep. of Germany

[21] Appl. No.: 145,976

[22] Filed: May 2, 1980

[30] Foreign Application Priority Data

May 17, 1979 [DE] Fed. Rep. of Germany ... 7914320[U]

[51] Int. Cl.[3] ..... C10B 25/20; F16J 15/40

[52] U.S. Cl. ..... 277/135; 202/242; 202/269

[58] Field of Search ..... 202/242, 247, 248, 269; 277/135, 13, 14, 17, 18, 19

[56] References Cited

U.S. PATENT DOCUMENTS

| | | | |
|---|---|---|---|
| 179,221 | 6/1876 | Ricketts | 202/247 |
| 192,884 | 7/1877 | Ubil | 202/247 |
| 832,976 | 10/1906 | Jackson | 202/242 |
| 2,379,547 | 7/1945 | Sperry | 277/135 |
| 2,424,865 | 7/1947 | Tweit | 202/256 |
| 4,103,902 | 8/1978 | Steiner | 277/135 |
| 4,186,056 | 1/1980 | Müller | 202/269 |

*Primary Examiner*—Robert I. Smith
*Attorney, Agent, or Firm*—McGlew and Tuttle

[57] ABSTRACT

An immersion type seal for a standpipe opening of a coke oven comprises a standpipe which has a top part with top opening and an encircling rim around the opening which is closed by a standpipe lid and an annular seal frame interposed between the lid and the opening. The seal frame includes a lower peripheral edge which is of spherical shape which is seated on a ring disposed over the rim of the standpipe top opening and the seal frame is advantageously adjusted on the seating ring and clamped by means of tie rods which are disposed at spaced locations around the periphery of a flange portion of the seal frame. The tie rods are clamped between flanges of a top piece of the standpipe and the standpipe itself and the flange of the seal frame. The seal frame also defines an open top trough which defines a water seal and the standpipe lid includes an annular wall portion which extends into the trough. The standpipe lid also advantageously includes an inner annular wall portion which is adapted to seat on a ledge portion of the annular sealing frame.

6 Claims, 1 Drawing Figure

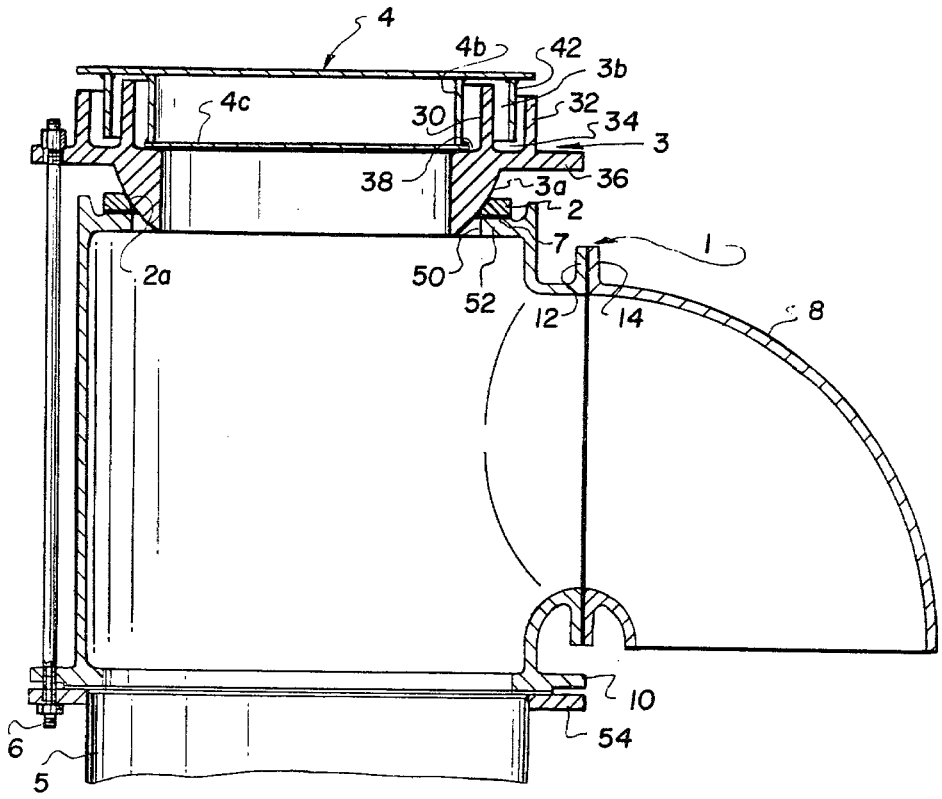
4
4b
42
3b
4c
30
32
34
3
38
3a
36
2
7
1
2a
50
52
12
14
8
10
54
6
5

IMMERSION-TYPE SEAL FOR THE STANDPIPE OPENING OF COKE OVENS

FIELD AND BACKGROUND OF THE INVENTION

This invention relates in general to coke ovens and in particular to a new and useful immersion-type seal for a coke oven standpipe, which includes a seal member or frame which has an annular lower peripheral spherical surface with seats on a ring which is placed on a rim of the standpipe of the coke oven and a lid which cooperates with the seal frame in closing the top of the coke oven standpipe.

An immersion-type seal is known from German utility model application No. 7807265. In gas conduction lines, water seals have proved satisfactory at differential pressures of up to some hundred millimeters of water column. They have recently been successfully tested also in connection with standpipe covers, so that they are now used for this purpose at a growing rate in new coke oven plants. In existing plants where the usual standpipe lids are provided with a dry metallic seal, there is also a tendency to re-equip the standpipes with an immersion-type seal. That is, experience has shown that with conventional dry metallic seals, after a longer period of service and, particularly, if the sealing faces are insufficiently cleaned from crude tar deposits, strong coal gas emissions frequently occur causing considerable pollution of the environment.

Both in new plants and in re-equipped ones, the use of immersion-type seals for standpipe lids requires the necessary water level in the seal during the entire time period of operating the coke oven chamber, and also at all locations of the water trough. It is known to size the water trough sufficiently to ensure that a single filling with water will secure the seal throughout the entire coking time of an oven, in spite of the intense evaporation caused by the high temperatures, so that one filling at the start of the cycle will do. Another possibility is to provide a trough with an inlet and outlet and to circulate the water continuously. This is advantageous insofar as, according to experience, the temperature of the water remains uniformly at a low level, less water evaporates, and with calcareous water, boiler-scale deposits are eliminated to a large extent.

What is particularly important in any case of using immersion-type seals for standpipe lids is to ensure that the water trough constantly remains in a horizontal position. This is a problem with standpipes on coke ovens, which, at the present state of the art, are up to 6 meters high and are supported on the refractory wall structure of the coke ovens which may become displaced by the unequal dilation during the heating-up period and cause an inclined position of the standpipes. Primarily in existing plants, it would be very expensive to rectify the position of inclined standpipes or to provide individually adjusted intermediate pieces for each of the standpipes. The same, however, goes for the initial period of operation and corrections during the following years in new plants.

SUMMARY OF THE INVENTION

The invention is directed to an immersion-type seal of the above-mentioned kind which is usable both in new plants and as re-equipment in existing plants and makes it possible to compensate in a simple way for an inclined standpipe position, to the effect that the trough constantly occupies an exactly horizontal position and ensures a satisfactory sealing of the standpipe lid by maintaining a uniform water level.

In accordance with the invention, a seal frame is disposed on a seal ring placed on the top rim of the top part of the standpipe and it includes a lower spherical surface which seats on the ring and may be adjustably positioned and clamped thereron by tie rods. The upper part of the sealing frame includes a water seal trough which opens on the top and receives an annular wall of a standpipe lid which closes the top.

An adjustable support in this connection means that during the assembly as well as during later operation, the seal frame can be angularly displaced on a spherical surface relative to the supporting surface and thereby brought into an exactly horizontal position. The supporting surface provided at the upper inner rim of the top part of the standpipe is designed as an only narrow, slightly beveled annular face.

Especially if previously installed, standpipe seals are to be reconstructed, it is advantageous to provide a ring between the seal frame and the top part of the standpipe, which ring bears against the top part through a resilient seal and directly supports the seal frame which is adjustable thereon. By providing such an additional ring, two smooth mating metallic surfaces are obtained between the ring and the seal frame. The resulting surfaces are displaceable relative to each other as needed and, along with the tar condensate which rapidly deposit there, form an efficient gastight seal, and, on the other hand, any uneven or slightly damaged areas on the upper rim of the standpipe are compensated by the resilient seal provided between the ring and the top part of the standpipe.

In numerous existing coke oven batteries, the upper opening of the standpipe extends in an inclined plane, not horizontally, so that a re-equipment with an immersion-type seal is not possible without further adaptation. To this end, the invention provides a wedge-shaped ring between the seal frame and the top part of the standpipe.

Advantageously, the seal frame is adjustably connected to the standpipe by means of two or more tie rods, which are provided at locations uniformly distributed over the circumference. The tie rods may be secured to flanges, hooks, or holding pockets which are provided for this purpose on the upper rim of the standpipe, or longer tie rods may be screwed to an already existing flange, for example, the flange connecting the uppermost and next standpipe valves. In any event, the tie rods have a certain minimum length to permit an adjustment of several centimeters between the seal frame and the standpipe or the rim supported thereon. This requires a sufficient number of threads, if anchor bolts are used.

Accordingly, it is an object of the invention to provide an immersion-type seal for a standpipe opening of coke ovens which comprises a standpipe which has a top part with a top opening with an encircling rim with an annular seal frame which has a bottom peripheral spherical edge overlying the rim and sealing the opening preferably by engaging with a separate seal ring and which also has an open top water sealing trough and which further includes a standpipe lid having an annular skirt portion engaged in the sealing trough and a top which closes the top of the seal frame.

A further object of the invention is to provide an immersion-type seal for standpipe lids on coke ovens which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a partial sectional view of a coke oven standpipe closure for a coke oven constructed in accordance with the invention.

DESCRIPTION OF THE PREFERRED EMBODIMENT

Referring to the drawing, in particular the invention embodied therein comprises a coke oven having a standpipe portion 5 with a top part generally designated 1 which has a flange 10 secured over a flange part 54 of the lower section of the standpipe 5. In addition a bend fitting 8 has a flange 14 secured to a flange 12 of the top part 1. The top part 1 includes an opening 50 which is bounded by a rim 52.

In accordance with the invention a resilient seal 7 is placed on the rim 52 and on top of the seal 7 a ring 2 is disposed which advantageously may have an inner spherical seal seat 2*a*. In accordance with the invention an annular sealing frame generally designated 3 is disposed over the opening 50 and it includes a peripheral spherical edge 3*a* at its bottom which engages over the ring 2 and seals the opening 50 together with a standpipe lid generally designated 4.

The seal frame 3 also includes wall means defining a water trough 3*b* which is opened upwardly. The wall means comprises an inner annular wall 30 and an outer annular wall 32 with a web portion 34 connected therebetween. In addition, the annular seal frame includes an annular flange portion having openings for the passage of tie rods 6 therethrough and it also includes an inner ledge portion 38.

In accordance with another feature of the invention, the standpipe lid 4 includes an annular wall 4*a* which engages in the water trough 3*b* and also includes an inner wall 4*b* which is connected to a plate portion 4*c* having a bottom surface which rests on the ledge 38.

The annular seal frame may be adjustably fitted to the spherical surface 2*a* of the ring 2 or directly on the rim 52 and its position may be adjusted to affect the proper seating and sealing. In the adjusted position the seal frame 3 is clamped in position by the tie rod 6 which also extend through openings in flanges 10 and 54. The adjustment of the seal frame is carried out by the aid of the tie rods which are connected between the upper part and the lower part 1 in the lower part 5 of the standpipe and they are advantageously arranged at spaced circumferential locations around the periphery of each flange and they serve the purpose of adjusting as well as sealing the sealing frame 3 with the ring 2. The tie rods are advantageously located at uniformly spaced locations around the circumference of the flanges.

While a specific embodiment of the invention has been shown and described in detail to illustrate the application of the principles of the invention, it will be understood that the invention may be embodied otherwise without departing from such principles.

What is claimed is:

1. An immersion-type seal for a standpipe opening of coke ovens, comprising a standpipe having a top opening with an annular encircling rim, an annular seal frame having a bottom peripheral spherical edge overyling said rim and sealing the opening, said seal frame having wall portions defining an open topped water sealing trough, and a standpipe lid having an annular skirt portion engaged in said water trough and a top closing the top of said seal frame.

2. An immersion-typ seal according to claim 1 including a sealing ring disposed over said rim and having a sealing surface engaged with said peripheral sealing edge of said seal frame.

3. An immersion-type seal according to claim 2 wherein said sealing ring has a partial spherical surface engaged with the spherical edge of said seal frame.

4. An immersion-type seal according to claim 3 including a resilient seal disposed between said ring and said rim.

5. An immersion-type seal according to claim 1 including means for clamping said seal frame to said standpipe.

6. An immersion-type seal according to claim 1 wherein said standpipe includes an upper part having an annular flange spaced downwardly from said seal frame, said seal frame having an annular flange overlying said flange portion of said upper part of said standpipe and tie rods extending between said seal frame and said flange part of said standpipe clamping said seal frame to said standpipe.

* * * * *